US008819881B2

(12) United States Patent
Gibis et al.

(10) Patent No.: US 8,819,881 B2
(45) Date of Patent: Sep. 2, 2014

(54) ELECTROSTATIC DUST COLLECTOR

(75) Inventors: Karl-Ludwig Gibis, Limburgerhof (DE); Mike Kosub, Bruchsal (DE); Thomas Leibfried, Bruchsal (DE); Christoph Herold, Karlsruhe (DE)

(73) Assignee: Carl Freudenberg KG, Weinheim (DE)

( * ) Notice: Subject to any disclaimer, the term of this patent is extended or adjusted under 35 U.S.C. 154(b) by 303 days.

(21) Appl. No.: 13/383,954

(22) PCT Filed: Jul. 12, 2010

(86) PCT No.: PCT/EP2010/004233
§ 371 (c)(1),
(2), (4) Date: Jan. 13, 2012

(87) PCT Pub. No.: WO2011/006630
PCT Pub. Date: Jan. 20, 2011

(65) Prior Publication Data

US 2012/0110756 A1 May 10, 2012

(30) Foreign Application Priority Data

Jul. 16, 2009 (DE) ..... 10 2009 033 550

(51) Int. Cl.
*A47L 13/40* (2006.01)
*A47L 13/38* (2006.01)
*B08B 6/00* (2006.01)

(52) U.S. Cl.
CPC ..... *A47L 13/40* (2013.01); *A47L 13/38* (2013.01); *B08B 6/00* (2013.01)
USPC ..... 15/1.52

(58) Field of Classification Search
CPC ..... A47L 13/38; A47L 13/40; B08B 6/00
USPC ..... 15/1.52
See application file for complete search history.

(56) References Cited

U.S. PATENT DOCUMENTS

| | | | | |
|---|---|---|---|---|
| 6,199,244 | B1 | 3/2001 | Hilgers et al. | |
| 7,843,237 | B2 * | 11/2010 | Strzalkowski et al. | 327/108 |
| 8,512,454 | B2 * | 8/2013 | Gibis et al. | 96/30 |
| 2003/0102774 | A1 * | 6/2003 | Carazo et al. | 310/317 |
| 2004/0163667 | A1 | 8/2004 | Learman | |

FOREIGN PATENT DOCUMENTS

| | | | |
|---|---|---|---|
| BE | 901726 | A * | 5/1985 |
| EP | 0992211 | A2 | 4/2000 |

OTHER PUBLICATIONS

International Search Report in International Patent Application No. PCT/EP2010/004233 Aug. 12, 2010.

* cited by examiner

*Primary Examiner* — Shay Karls
(74) *Attorney, Agent, or Firm* — Leydig, Voit & Mayer, Ltd.

(57) ABSTRACT

Electrostatic dust collector comprising a first (1) and a second electrode (2), a voltage source (3) for applying a voltage between the two electrodes (1, 2), and a connection to ground (2*a*) is provided. The first electrode (1) and the second electrode (2) form a dust collection device, the first electrode (1) being positively charged and the second electrode (2) being negatively charged.

19 Claims, 4 Drawing Sheets

ELECTROSTATIC DUST COLLECTOR

CROSS-REFERENCED TO RELATED APPLICATION

This patent is the national phase of PCT/EP2010/004233, filed Jul. 12, 2010, which claims the benefit of German Patent Application No. 10 2009 033 550.1, filed Jul. 16, 2009.

FIELD OF THE INVENTION

The invention relates to an electrostatic dust collector.

BACKGROUND OF THE INVENTION

An electrostatic dust mop is disclosed in US 2004/0163667 A1. The previously known dust collector includes a first and a second electrode and a voltage source for applying a voltage between the two electrodes.

The known dust collector is constructed as a floor cleaning apparatus and has a grid-like mat, the two electrodes being components of the mat. The mat can be covered, for example, by a cleaning cloth. The voltage source is a battery arranged in the handle, for example, with the output voltage being converted into a high voltage. The area between the electrodes is electrically charged, the dust to be picked up having an opposite polarity with respect to the electrodes and being thereby attracted. Also disclosed is a charging station for the dust collector, if the power source is a rechargeable battery rather than a disposable one. The previously known dust collector can also comprise motion detectors in order to automatically charge the dust collector electrostatically when it is moved. When the dust collector is parked, it can be automatically discharged. Due to the arrangement of the two electrodes in the grid-like mat, the previously known dust collector has the disadvantage that the highest field line density of the electric field, and thus the greatest polarization effect, is limited to the area between the two electrodes. Because of the flat arrangement of the two electrodes, no significant force acts on particles outside the electrodes. The particles must first reach the area between the electrodes in order to be sufficiently polarized and then attracted by one electrode. Such electrode configurations and geometries are not capable of attracting dust particles over a distance of centimeters—or even several millimeters—by electrostatic forces. Covering the electrodes with a textile can completely prevent the particles from reaching the area with the greatest field strength between the electrodes and further reduces the performance of the previously known device.

SUMMARY OF THE INVENTION

An object of the invention is to avoid the above-mentioned disadvantages, by providing a dust collector having a good efficiency and handling ability during intended use, despite a simple electrode geometry. The dust collector is also intended to be easily and inexpensively manufactured.

To this end, an electrostatic dust collector is provided that includes a first and a second electrode, a voltage source for applying a positive and negative electric voltage to the two electrodes, and a ground. The first electrode and the second electrode form a dust collection device and the first electrode is positively charged and the second electrode is negatively charged. The grounding can be either direct, via an electrically conductive ground contact (e.g., for floor cleaning devices) or via the user and an electrically conductive handle (e.g., for manual dust collection devices). The dust collector according to the invention has a very good efficiency due to the positive charge of the first electrode and the negative charge of the second electrode. Negatively charged dust particles collect at the first electrode, and positively charged dust particles collect at the second electrode. The efficiency of the dust collector is therefore particularly good. It is additionally advantageous that the dust collector according to the invention is easy to handle and economical to produce due to its simple electrode geometry. Because of the oppositely polarized first and second electrodes and the ground connected via a handle or floor contact, the maximum potential difference between the dust on the surface and the electrodes directed at the dust is achieved, independently of whether the dust is positively or negatively charged. The dust is therefore subjected to a particularly strong attraction force.

The dust collector according to the invention is thus particularly suitable for dry removal of dust on ordinary household surfaces. The efficiency can be increased by selecting suitable electrode materials and suitable electrode geometries for optimizing the electric field of the electrodes exposed to the dust.

The ground is preferably formed as a handle. The grounding via the user by a handle conductively connected to the circuit ground has the further advantage that the voltage source can build up a positive and negative potential with respect to the surrounding ground, which further increases the attraction force on the dust. Because of the positive and negative high voltage on the electrodes, functionality remains even if the user becomes electrostatically charged.

In a design as a floor cleaning device, the voltage source can be housed in the frame holding the electrodes, and it can be arranged in the handle for handheld devices. The handle usually encloses a sufficient space to hold the voltage source. The handling of such a dust collector is particularly good because its center of gravity is close to the user's body, thus avoiding undesired leverage effects such as those when using a very top-heavy cleaning device. The voltage source is also well protected from external influences by its arrangement in the handle. Such a dust collector has a good long-term durability along with good reliability.

At its output, the voltage source delivers one or more positive and negative voltages with a high arithmetic mean value. A disposable or rechargeable battery can be used on the input side. Any method for generating voltages with a high arithmetic mean value can be used as the voltage source, preferably a self-oscillating or resonant converter circuit based on the flyback or push-pull principle with a transformer and downstream multistage rectifier.

A flyback or push-pull converter converts an input DC voltage into an AC voltage. The switching elements, e.g., transistors, integrated into the converters are driven in the self-oscillating version via a feedback signal from the transformer, and a resonant circuit is used in the resonant version.

The multistage rectifier circuit downstream of the converter converts the AC voltage generated by the converter into a high DC voltage. A Villard cascade voltage multiplier is preferably used as the multistage rectifier circuit.

The total capacitance of the capacitors used in the multistage rectifier circuit can lie in the range from 1 pF to 100 nF; the total capacitance is preferably 0.125 nF.

The input voltage of the voltage source can be up to 100 V, preferably up to 9 V, and the arithmetic mean value of the high voltage at the output of the voltage source can be up to ±100 kV, preferably up to ±10 kV.

Such a low input voltage can easily be provided by ordinary commercial batteries, which are available inexpensively almost everywhere. This is a significant advantage, especially in the field of inexpensive consumer products.

The arithmetic mean value of the high voltage can be adjustable stepwise or continuously. The attractive force that the electrodes exert on the dust to be collected is dependent on the magnitude of the high voltage. The magnitude of the high voltage is limited by the dielectric strength of the electrode insulation and the air, and by the electronics respectively used. If one and the same dust collector is to be used for collecting different types of dust and/or for collecting dust under different ambient conditions such as different air humidity, an adjustable high-voltage is advantageous, especially if it is continuously adjustable.

Because of the voltage source described above, the dust collector can be used independently of location and is freely movable.

The voltage source can be switched on and off by a charge switch. The handle can also have a discharge switch for discharging the electric voltage between the electrodes. For easier handling, the charge switch and the discharge switch can be brought together as a combination switch.

The electrodes can consist of suitable electrically conductive materials such as metallic, cellulose-containing or polymeric materials.

The electrodes must be electrically insulated in order to avoid discharging of the electrodes by the user or the environment.

The two electrodes exposed to the dust can each be covered, at least in part, by a dust cloth. It is further preferred that the two electrodes each be enclosed by a bag-like dust cloth. It is advantageous in this case that the dust can be collected not only contact-free by the potential difference and the resulting attractive force of the electrodes on the dust, but also by direct contact of the dust with the dust cloth. The cleaning power is increased in this way, especially if the dust is not merely lying loose on the surfaces to be cleaned, but rather adheres more strongly.

A dust cloth has particularly good usage characteristics if it consists at least partly of microfibers.

In general, the dust to be collected can be picked up by the dust collector in various ways.

The electrodes can be covered with a smooth, electrically nonconductive material so that the dust is fixed on this material due to the electrostatic charge. In this case, the dust is attracted from the surface to be cleaned over a distance of several centimeters by the device. The attraction takes place by means of influence and/or polarization.

In this connection, influence is understood to mean a charge shift in a conductor (e.g., in a conductive dust particle) due to an external electric field.

In contrast, polarization is understood in this context to mean that a charge shift is generated by the application of an external electric field (the electrodes in this case) in a nonconductive material (the dust particles in this case). Thereby a temporary dipole is generated in the particle, on which a force acts in the electric field.

Since household dust largely consists of poorly electrically conductive textile fibers, the phenomenon of polarization is primarily involved, with the limits for influence being fluid due to environmental conditions such as humidity.

On the other hand, the electrodes can be covered by a more or less strongly structured, electrically nonconductive textile such as a nonwoven fabric, a woven fabric, a knit, or fibers, in which case the textile holds the dust mechanically by means of its porous surface structure in addition to the electrostatic effect. The dust can either be picked up in this case by electrostatic attraction, without direct contact of the textile with the surface to be cleaned, or by direct contact of the textile with the surfaces to be cleaned, i.e., by a mechanical holding. The electrostatic effect is amplified in this case by the mechanical effect, which is particularly advantageous in case of tightly adhering, already aged dust. In another embodiment, the electrode can be covered with a smooth, nonconductive plastic material such as a plastic film on which the dust particles are deposited. Such a film allows subsequent removal of the dust by simply stripping the film off, or by simply tapping it off after the electrodes have been discharged.

BRIEF DESCRIPTION OF THE SEVERAL VIEWS OF THE DRAWINGS

Two embodiments of an electrostatic dust collector according to the invention will be described below with reference to the schematically represented FIGS. 1-4. Therein.

DETAILED DESCRIPTION OF THE INVENTION

Figure 1:
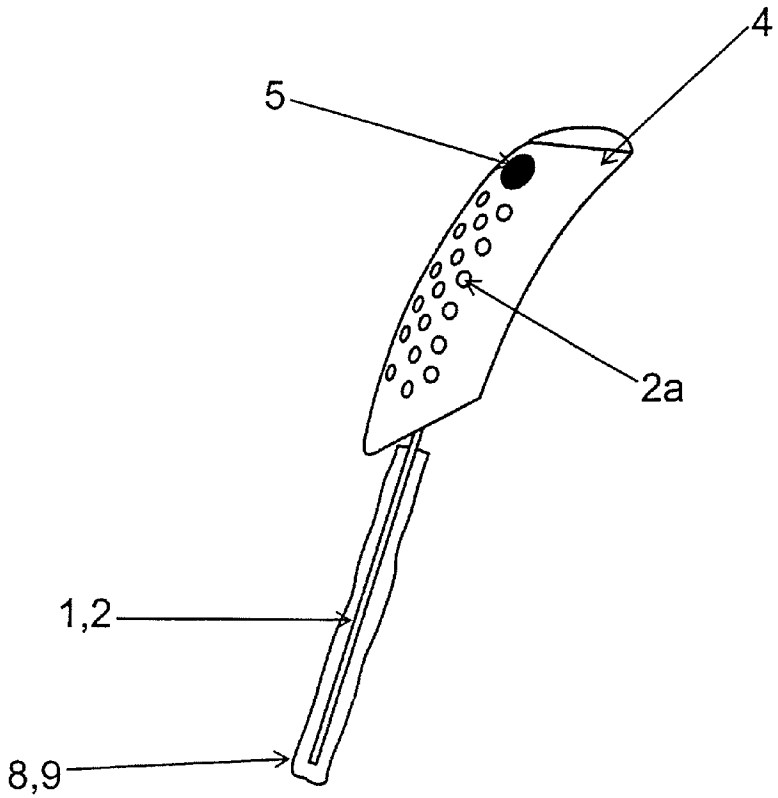
FIG. 1 is a schematic side view of an exemplary dust collector according to the invention.

FIGS. 1-4 show two embodiments of an electrostatic dust collector, each of which includes a handle 4 and a dust collection device that is mounted on the handle 4. The dust collection device is formed by a first electrode 1 and a second electrode 2, which are completely enclosed in the illustrated embodiments by a sack-like dust cloth 8, 9. The dust cloth 8, 9 can consist entirely or partially of microfibers. The ground 2*a* of the dust collector is integrated into the handle 4. The voltage source 3 is arranged inside the handle 4 and protectively enclosed by the handle 4. The voltage source 3 is understood within the scope of the present invention to mean a device supplied by a battery or storage battery that generates voltages with a high arithmetic mean value. In the exemplary embodiment, the input voltage (battery voltage) is 3 V and the arithmetic mean value of the high voltage is ±5 kV.

To guarantee optimal dust collection and prevent an unpleasant charging of the user, the handle 4 is conductively connected to the circuit ground. The handle 4 is drawn to ground potential by the user so that a potential difference between the two electrodes 1 and 2 and the ground results and dust is drawn to the two electrodes 1, 2 by the electrostatic dust collector.

The two electrodes 1, 2 can be comb-like in shape, with a slight internal potential difference.

The dust collector according to the invention has a very good efficiency due to the positive charge of the first electrode 1 and the negative charge of the second electrode 2. Negatively charged dust particles collect on the first electrode 1, and positively charged dust particles at the second electrode 2. The efficiency of the dust collector is therefore particularly good.

Dust particles can additionally be held on the surface of the electrodes 1, 2 by providing the electrodes with a comb-like structure. Thereby, the efficiency of the dust collected can be further increased.

Figure 2:
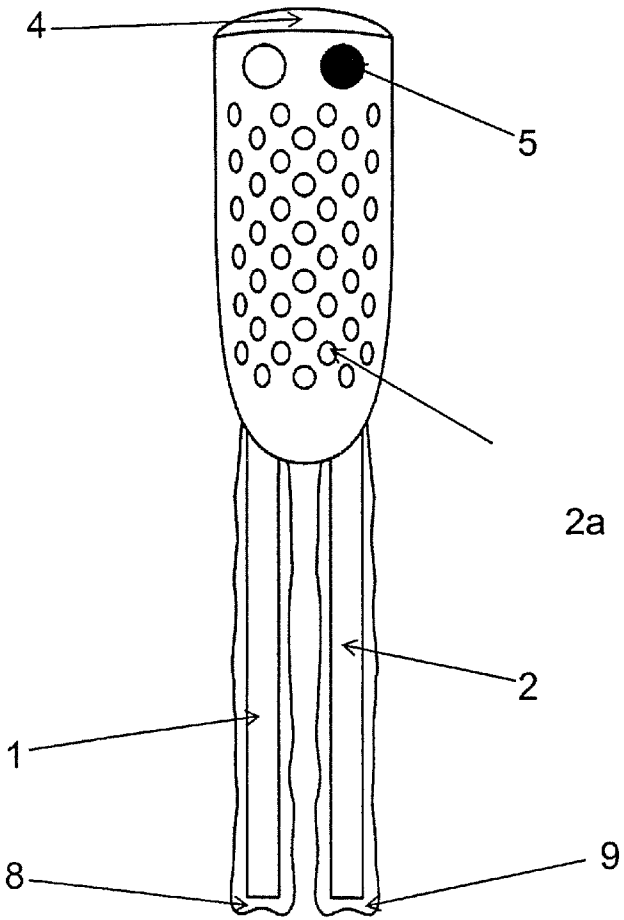
FIG. 2 is a schematic front view of the dust collector of FIG. 1.
Figure 3:
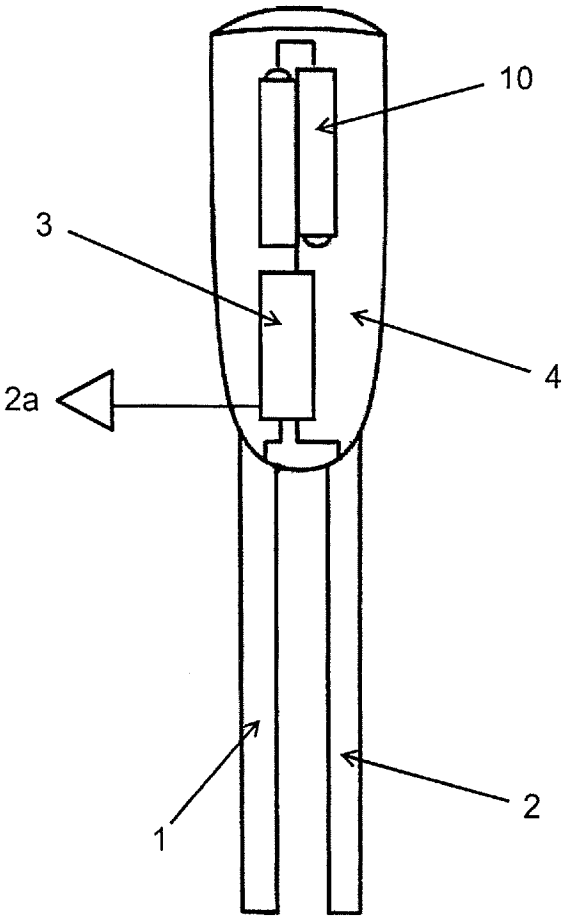
FIG. 3 is a schematic, cutaway, front view of the dust collector of FIG. 1 showing the interior of the handle.
Figure 4:
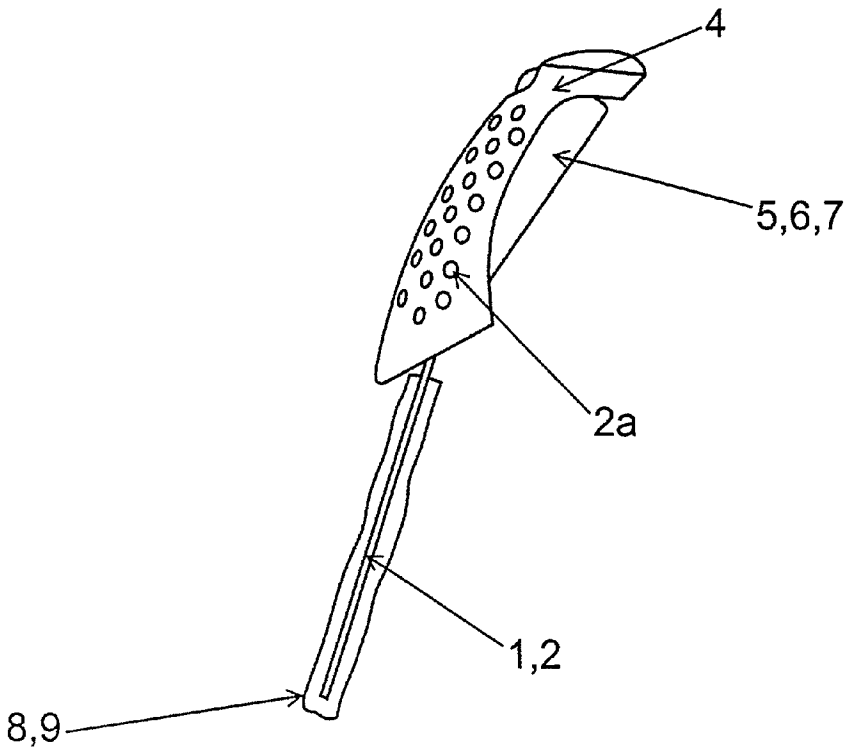
FIG. 4 is a side view of a second exemplary embodiment of a dust collector according to the invention that includes a combination switch.

In FIGS. 1-3, the handle 4 includes a charge switch 5 and a discharge switch 6, and in FIG. 4 it includes a combination switch 7 in which the charge switch 5 and the discharge switch 6 are combined.

When a user picks up the electrostatic dust collector, he actuates the charge switch 5 or the combination switch 7—and therefore the charge switch 5—in order to apply an electric charge to the electrodes 1, 2. The charge remains as long as the charge switch 5/combination switch 7 is pressed and the capacitors contained in the device are not discharged. Following the cleaning process, the dust collector laden with dust can be stored in a cleaning station, for example. Subsequently the discharge switch 6, or the combination switch 7 and therefore the discharge switch 6, is actuated. The pressing can either be done automatically by the user or automatically by placing the dust collector in the cleaning station. Thereby there is a discharge and the dust can be stripped off, washed off or tapped off the two electrodes 1, 2 without problems. The dust collector is subsequently again ready for operation.

LIST OF REFERENCE NUMBERS

1 First electrode
2 Second electrode
2*a* Ground
3 Voltage source
4 Handle
5 Charge switch
6 Discharge switch
7 Combination switch
8 Dust cloth
9 Dust cloth
10 Batteries

The invention claimed is:

1. An electrostatic dust collector, comprising: a first electrode and a second electrode, a voltage source for applying a positive and negative electric voltage to the first and second electrodes, and a ground comprising an electrically conductive element connectable to a ground, wherein the first electrode and the second electrode form a dust collection device and wherein the first electrode is positively charged and the second electrode is negatively charged and the first and second electrodes are each at least partially covered by a dust cloth.

2. The dust collector according to claim 1, further including a handle, wherein the ground is integrated into the handle.

3. The dust collector according to claim 1, further including a handle, wherein the voltage source is arranged in the handle.

4. The dust collector according to claim 1, wherein the voltage source is constructed as a device for generating voltages with a high arithmetic mean value that is supplied by a battery.

5. The dust collector according to claim 4, wherein the voltage source comprises a flyback converter with downstream Villard cascade voltage multiplier.

6. The dust collector according to claim 4, wherein the voltage source comprises a push-pull converter.

7. The dust collector according to claim 4, wherein the voltage source comprises a converter that is self-oscillating or resonant.

8. The dust collector according to claim 4, further comprising a capacitor with a total capacitance at an output, wherein the capacitance is 1 pF to 100 nF.

9. The dust collector according to claim 8, wherein the total capacitance is 0.125 nF.

10. The dust collector according to claim 4, wherein the arithmetic mean value of the high-voltage is adjustable stepwise or continuously.

11. The dust collector according to claim 1, wherein the voltage source is constructed based on mechanical charge separation.

12. The dust collector according to claim 1, wherein the voltage source has an input voltage of up to 100 V and the arithmetic mean value of a high voltage at an output of the voltage source is up to ±100 kV.

13. The dust collector according to claim 12, wherein the input voltage of the voltage source is up to 9 V.

14. The dust collector according to claim 12, wherein the high voltage at the output of the voltage source is up to ±10 kV.

15. The dust collector according to claim 1, wherein the voltage source can be switched on or off by a charge switch.

16. The dust collector according to claim 1, further including a handle, wherein the handle includes a discharge switch for discharging the electric voltage between the electrodes.

17. The dust collector according to claim 15, further including a discharge switch for discharging the electric voltage between the electrons and wherein the charge switch and the discharge switch are brought together in a combination switch.

18. The dust collector according to claim 1, wherein each dust cloth has a bag-like configuration.

19. The dust collector according to claim 1, wherein the dust cloths consist each dust cloth consists at least partially of microfibers.

* * * * *